US009670750B2

(12) United States Patent
Chauffe

(10) Patent No.: US 9,670,750 B2
(45) Date of Patent: Jun. 6, 2017

(54) METHODS OF OPERATING WELL BORE STIMULATION VALVES

(71) Applicant: Team Oil Tools LP, The Woodlands, TX (US)

(72) Inventor: Stephen J. Chauffe, The Woodlands, TX (US)

(73) Assignee: TEAM OIL TOOLS, LP, The Woodlands, TX (US)

( * ) Notice: Subject to any disclaimer, the term of this patent is extended or adjusted under 35 U.S.C. 154(b) by 842 days.

(21) Appl. No.: 13/963,787

(22) Filed: Aug. 9, 2013

(65) Prior Publication Data

US 2015/0041133 A1 Feb. 12, 2015

(51) Int. Cl.

| | |
|---|---|
| ***E21B 34/10*** | (2006.01) |
| ***E21B 34/06*** | (2006.01) |
| ***E21B 43/26*** | (2006.01) |
| ***E21B 34/14*** | (2006.01) |
| ***E21B 43/14*** | (2006.01) |

(52) U.S. Cl.

CPC ..... *E21B 34/10* (2013.01); *E21B 34/06* (2013.01); *E21B 34/063* (2013.01); *E21B 34/102* (2013.01); *E21B 34/14* (2013.01); *E21B 43/14* (2013.01); *E21B 43/26* (2013.01); *E21B 43/261* (2013.01)

(58) Field of Classification Search

CPC .. E21B 2034/007; E21B 34/063; E21B 34/10; E21B 34/102; E21B 34/103; E21B 43/26; E21B 43/261; E21B 33/138

See application file for complete search history.

(56) References Cited

U.S. PATENT DOCUMENTS

| | | | | |
|---|---|---|---|---|
| 3,011,548 | A | 7/1958 | Holt | |
| 6,059,032 | A | 5/2000 | Jones | |
| 6,286,594 | B1 * | 9/2001 | French | E21B 34/10 166/151 |
| 8,267,178 | B1 * | 9/2012 | Sommers | E21B 34/102 166/317 |

(Continued)

FOREIGN PATENT DOCUMENTS

WO 2006/101618 A2 9/2006

OTHER PUBLICATIONS

WO 2013/090289. Kofoed, Curtis, W. et al. Completing a Well in a Reservoir. Published Jun. 20, 2013.*

Invitation to Pay Additional Fees (w/Partial Int'l Search), Serial No. PCT/US/2014/044474 (Mar. 17, 2015).

Int'l Search Report, Serial No. PCT/US/2014/044474 (May 22, 2015).

(Continued)

*Primary Examiner* — Nicole Coy
*Assistant Examiner* — Tara Schimpf
(74) *Attorney, Agent, or Firm* — MH2 Technology Law Group, LLP

(57) ABSTRACT

Methods of controlling flow into a formation through the use of a stimulation valve in a tubular assembly installed in a well. Fluid is pumped into the formation through one or more ports in the stimulation valve. The stimulation valve defines a conduit for flow of fluids through the stimulation valve. The ports are adapted to allow flow of fluids between the conduit and the exterior of the stimulation valve and to receive a ball sealer for shutting off flow of fluids through the ports. The ports then are closed by introducing a plurality of ball sealers into the fluid. The fluid carries the ball sealers into the valve where they seat on and shut off flow of the fluid through the ports.

18 Claims, 4 Drawing Sheets

(56) References Cited

U.S. PATENT DOCUMENTS

| | | | | |
|---|---|---|---|---|
| 8,434,559 | B2 | 5/2013 | Todd et al. | |
| 2008/0156498 | A1* | 7/2008 | Phi | E21B 43/26 166/376 |
| 2009/0255674 | A1 | 10/2009 | Boney et al. | |
| 2011/0100643 | A1 | 5/2011 | Themig et al. | |
| 2011/0226479 | A1 | 9/2011 | Tippel et al. | |
| 2012/0214715 | A1 | 8/2012 | Luo et al. | |
| 2012/0279723 | A1* | 11/2012 | Hofman | E21B 34/063 166/373 |
| 2013/0025872 | A1* | 1/2013 | Mailand | E21B 34/063 166/332.1 |
| 2013/0048304 | A1 | 2/2013 | Agrawal et al. | |
| 2013/0192828 | A1* | 8/2013 | Kniffin | E21B 33/138 166/284 |

OTHER PUBLICATIONS

Written Opinion of the Int'l Searching Authority, Serial No. PCT/US/2014/044474 (May 22, 2015).

R. Angeles et al., *First Application of Just-in-Time Perforating in a Horizontal Well*, SPE Hydraulic Fracturing Technology Conference (Feb. 6-8, 2012).

R. Angeles at al., *One Year of Just-in-Time Perforating as Multi-Stage Fracturing Technique for Horizontal Wells*, SPE Annual Technical Conference and Exhibition (Oct. 8-10, 2012).

Halliburton, *Horizontal Completion Systems*.

Schlumberger, *Falcon Ball-Actuated Frac Valve* (© 2012 Schlumberger).

Schlumberger, *Falcon Hydraulic-Actuated Frac Valve* (© 2012 Schlumberger).

Team Oil Tools, *ORIO Toe Valve* (© 2012 Team Oil Tools).

* cited by examiner

METHODS OF OPERATING WELL BORE STIMULATION VALVES

FIELD OF THE INVENTION

The present invention relates to methods of introducing fluids into oil and gas bearing formations so that production of hydrocarbons from a well is enhanced, and more particularly, to methods of operating valves used to introduce stimulation fluids into the formation and to tubular assemblies used to stimulate formations.

BACKGROUND OF THE INVENTION

Hydrocarbons, such as oil and gas, may be recovered from various types of subsurface geological formations. The formations typically consist of a porous layer, such as limestone and sands, overlaid by a nonporous layer. Hydrocarbons cannot rise through the nonporous layer, and thus, the porous layer forms a reservoir in which hydrocarbons are able to collect. A well is drilled through the earth until the hydrocarbon bearing formation is reached. Hydrocarbons then are able to flow from the porous formation into the well.

In what is perhaps the most basic form of rotary drilling methods, a drill bit is attached to a series of pipe sections referred to as a drill string. The drill string is suspended from a derrick and rotated by a motor in the derrick. A drilling fluid or "mud" is pumped down the drill string, through the bit, and into the well bore. This fluid serves to lubricate the bit and carry cuttings from the drilling process back to the surface. As the drilling progresses downward, the drill string is extended by adding more pipe sections.

When the drill bit has reached the desired depth, larger diameter pipes, or casings, are placed in the well and cemented in place to prevent the sides of the borehole from caving in. Cement is introduced through a work string. As it flows out the bottom of the work string, fluids already in the well, so-called "returns," are displaced up the annulus between the casing and the borehole and are collected at the surface.

Once the casing is cemented in place, it is perforated at the level of the oil bearing formation to create openings through which oil can enter the cased well. Production tubing, valves, and other equipment are installed in the well so that the hydrocarbons may flow in a controlled manner from the formation, into the cased well bore, and through the production tubing up to the surface for storage or transport.

This simplified drilling and completion process, however, is rarely possible in the real world. Hydrocarbon bearing formations may be quite deep or otherwise difficult to access. Thus, many wells today are drilled in stages. An initial section is drilled, cased, and cemented. Drilling then proceeds with a somewhat smaller well bore which is lined with somewhat smaller casings or "liners." The liner is suspended from the original or "host" casing by an anchor or "hanger." A seal also is typically established between the liner and the casing and, like the original casing, the liner is cemented in the well. That process then may be repeated to further extend the well and install additional liners. In essence, then, a modern oil well typically includes a number of tubes wholly or partially within other tubes.

Moreover, hydrocarbons are not always able to flow easily from a formation to a well. Some subsurface formations, such as sandstone, are very porous. Hydrocarbons are able to flow easily from the formation into a well. Other formations, however, such as shale rock, limestone, and coal beds, are only minimally porous. The formation may contain large quantities of hydrocarbons, but production through a conventional well may not be commercially practical because hydrocarbons flow though the formation and collect in the well at very low rates. The industry, therefore, relies on various techniques for improving the well and stimulating production from formations. In particular, various techniques are available for increasing production from formations which are relatively nonporous.

One technique involves drilling a well in a more or less horizontal direction, so that the borehole extends along a formation instead of passing through it. More of the formation is exposed to the borehole, and the average distance hydrocarbons must flow to reach the well is decreased. Another technique involves creating fractures in a formation which will allow hydrocarbons to flow more easily. Indeed, the combination of horizontal drilling and fracturing, or "frac'ing" or "fracking" as it is known in the industry, is presently the only commercially viable way of producing natural gas from the vast majority of North American gas reserves.

Fracturing typically involves installing a production liner in the portion of the well bore which passes through the hydrocarbon bearing formation. In shallow wells, the production liner may actually be the casing suspended from the well surface. In either event, the production liner is provided, by various methods discussed below, with openings at predetermined locations along its length. Fluid, most commonly water, then is pumped into the well and forced into the formation at high pressure and flow rates, causing the formation to fracture and creating flow paths to the well. Proppants, such as grains of sand, ceramic or other particulates, usually are added to the frac fluid and are carried into the fractures. The proppant serves to prevent fractures from closing when pumping is stopped.

A formation usually is fractured at various locations, and rarely, if ever, is fractured all at once. Especially in a typical horizontal well, the formation usually is fractured at a number of different points along the bore in a series of operations or stages. For example, an initial stage may fracture the formation near the bottom of a well. The frac job then would be completed by conducting additional fracturing stages in succession up the well.

Some operators prefer to perform a frac job on an "open hole," that is without cementing the production liner in the well bore. The production liner is provided with a series of packers and is run into an open well bore. The packers then are installed to provide seals between the production liner and the sides of the well bore. The packers are spaced along the production liner at appropriate distances to isolate the various frac zones from each other. The zones then may be fractured in a predetermined sequence. The packers in theory prevent fluid introduced through the liner in a particular zone from flowing up or down the well bore to fracture the formation in areas outside the intended zone.

Certain problems arise, however, when an open hole is fractured. The distance between packers may be substantial, and the formation is exposed to fluid pressure along that entire distance. Thus, there is less control over the location at which fracturing of a formation will occur. It will occur at the weakest point in the frac zone, i.e., the portion of the well bore between adjacent packers. Greater control may be obtained by increasing the number of packers and diminishing their separation, but that increases the time required to complete the frac job. Moreover, even if packers are tightly spaced, given the extreme pressures required to fracture some formations and the rough and sometimes frangible surface of a well bore, it may be difficult to achieve an effective seal with a packer. Thus, fluid may flow across a packer and fracture a formation in areas outside the intended zone.

In part for such reasons, many operators prefer to cement the production liner in the well bore before the formation is fractured. Cement is circulated into the annulus between the production liner and well bore and is allowed to harden before the frac job is commenced. Thus, frac fluid first penetrates the cement in the immediate vicinity of the inner openings before entering and fracturing the formation. The cement above and below the liner openings serves to isolate other parts of the formation from fluid pressure and flow. Thus, it is possible to control more precisely the location at which a formation is fractured when the production liner is first cemented in the well bore. Cementing the production liner also tends to more reliably isolate a producing formation than does installing packers. Packers seat against a relatively small portion of the well bore, and even if an effective seal is established initially, packers may deteriorate as time passes.

There are various methods by which a production liner is provided with the openings through which frac fluids enter a formation. In a "plug and perf" frac job, the production liner is made up from standard lengths of casing. The liner does not have any openings through its sidewalls. It is installed in the well bore, either in an open bore using packers or by cementing the liner, and holes then are punched in the liner walls. The perforations typically are created by so-called perforation guns which discharge shaped charges through the liner and, if present, adjacent cement.

The production liner typically is perforated first in a zone near the bottom of the well. Fluids then are pumped into the well to fracture the formation in the vicinity of the perforations. After the initial zone is fractured, a plug is installed in the liner at a point above the fractured zone to isolate the lower portion of the liner. The liner then is perforated above the plug in a second zone, and the second zone is fractured. That process is repeated until all zones in the well are fractured.

The plug and perf method is widely practiced, but it has a number of drawbacks. Chief among them is that it can be extremely time consuming. The perf guns and plugs must be run into the well and operated individually, often times at great distance and with some difficulty. After the frac job is complete, it also may be necessary to drill out or otherwise remove the plugs to allow production of hydrocarbons through the liner. Thus, many operators prefer to frac a formation using a series of frac valves.

Such frac valves typically include a cylindrical housing that may be threaded into and forms a part of a production liner. The housing defines a central conduit through which frac fluids and other well fluids may flow. Ports are provided in the housing that may be opened, most commonly by actuating a sliding sleeve. Once opened, fluids are able to flow through the ports and fracture a formation in the vicinity of the valve.

The sliding sleeves in such valves traditionally have been actuated either by creating hydraulic pressure behind the sleeve or by dropping a ball on a ball seat which is connected to the sleeve. Typical multi-stage fracking systems will incorporate both types of valves. Halliburton's RapidSuite sleeve system and Schlumberger's Falcon series sleeves, for example, utilize a hydraulically actuated "initiator" valve and a series of ball-drop valves.

More particularly, the production liner in those systems is provided with a is hydraulically actuated sliding sleeve valve which, when the liner is run into the well, will be located near the bottom of the well bore in the first fracture zone. The production liner also includes a series of ball-drop valves which will be positioned in the various other fracture zones extending uphole from the first zone. The seat on each valve must be big enough to allow passage of the balls required to actuate every valve below it. Conversely, the ball used to actuate a particular valve must be smaller than the balls used to actuate every valve above it. Thus, starting with the lowermost valve, the ball-drop valves will have increasingly larger ball seats as they move up the liner.

A frac job will be initiated by increasing fluid pressure in the production liner. The increasing pressure will actuate the sleeve in the bottom, hydraulic valve, opening the ports and allowing fluid to flow into the first fracture zone. Once the first zone is fractured, a ball is dropped into the well and allowed to settle on the ball seat of the ball-drop valve immediately uphole of the first zone. The seated ball isolates the lower portion of the production liner and prevents the flow of additional frac fluid into the first zone. Continued pumping will shift the seat downward, along with the sliding sleeve, opening the ports and allowing fluid to flow into the second fracture zone. The process then is repeated with each ball-drop valve uphole from the second zone until all zones in the formation are fractured.

Such systems may incorporate up to about twenty ball-drop valves and have been used successfully in many well completions. Using a series of valves avoids the time consuming process of running and setting perf guns and plugs. A formation may be fractured in multiple zones more quickly by dropping a succession of balls into the well to successively open the valves and isolate downhole zones.

Regardless of the method, however, multistage fracturing operations require that flow into one zone be shut off before, or more or less concurrently with commencing flow into the next zone. In plug and perf methods, as discussed above, the perforations are left open and plugs are installed between each zone. In liners provided with a series of valves, at least in theory the valve could be provided with a mechanism that not only would slide the sleeve to its open position, but that also would slide it shut when it was time to commence flow through another valve. Such mechanisms, however, are not typically present in sliding sleeve valves. More typically, as in the RapidSuite and Falcon systems discussed above, the ports are left open and flow into a zone is shut off by a shutting off flow into the valve. That is, balls dropped into a liner will settle on a ball is seat of a valve, and the seated ball will isolate those portions of the liner downhole from the valve.

While seated balls can effectively isolate downhole valves during a multi-stage fracturing operation, once fracturing of the well bore has been completed the ball seats may present significant restrictions in the liner which can reduce the subsequent flow of hydrocarbons up the liner. That is especially true when the liner has a large number of ball-drop valves. The lower ball seats may be quite small. Thus, it may be necessary to drill out the liner to remove the seats prior to production. Such operations can be time consuming and costly.

Moreover, many conventional valves are poorly suited for incorporation into a liner that will be cemented in place prior to fracturing the formation. The central conduit in many valves contains profiles and recesses that may cause cement passing through the valve as the liner is cemented in place to hang up in the valve. A cement wiper plug is typically pumped through the liner, but the presence of profiles and recesses may make it hard for the plug to cleanly wipe cement out of the valve. Ball seats, for example, may diminish the efficacy of a wiper plug. Thus, an operator may have to incur the expense and trouble of drilling out a liner before it can be cemented in the well.

The ability to selectively inject fluid into various zones in a well bore is important not only in fracturing, but in other processes for stimulating hydrocarbon production. Aqueous acids such as hydrochloric acid may be injected into a formation to clean up the formation. Water or other fluids may be injected into a formation from a "stimulation" well to drive hydrocarbons toward a production well. In many such stimulation processes, as in fracturing a well, the ability to selectively flow fluids out a series of valves may improve the efficacy and efficiency of the process.

It also may be necessary to stimulate production from existing wells which have a perforated liner. For example, new plugs may be installed to isolate perforations in an existing liner. Fluid may be injected into the formation through the isolated perforations, after which additional plugs are installed to isolate and inject stimulation fluids through is other perforations. Such processes, however, also can be costly, and for older, marginal wells, may be avoided in favor of using "perforation balls" or "ball sealers."

Such processes are commenced by pumping stimulation fluids into a perforated well. The fluids necessarily will flow preferentially into those portions of a formation offering the least resistance. After a quantity of fluid has been pumped into the initial, lowest resistance zone, a plurality of ball sealers are pumped into the liner. The ball sealers most commonly are relatively small, spherically shaped balls, but they may have other geometries. In any event, the ball sealers will flow preferentially into the perforations adjacent the lowest resistance zone, plugging those perforations. At that point stimulation fluids begin to flow preferentially through the perforations adjacent those zones offering the next lowest resistance. Pumping is continued for a period of time and another batch of ball sealers is pumped into the well to plug those perforations. The process is repeated until the zones adjacent all perforations have been stimulated.

Using ball sealers usually will be less costly and time consuming than setting and drilling out or retrieving a series of plugs. The technique is crude and imprecise, however, for a number of reasons. Because flow is always preferentially into the zone of least resistance, there is no control over the order in which zones are stimulated and the operator may end up stimulating zones that did not require stimulation in order to ensure that the target zone was stimulated. Although the simplified description above may suggest otherwise, there also is little control over the amount of fluids pumped into a particular zone. Fluid may initially flow preferentially into one zone, but then because of changing resistance, may begin to flow preferentially into another zone.

Perforations in a liner also may not be uniform, either as formed or after years of exposure to well fluids. Perforation openings may be elongated due to the casing curvature and the angle at which the perforation gun was discharged. Perforations also may have been formed with burrs or uneven surfaces, or they may corrode or accumulate scale. Thus, it may be difficult to shut off flow through perforations in a well with any given size or configuration of ball sealer. Various solutions to such issues have been proposed, such as the use of sealing agents as disclosed in U.S. Pat. Publ. 2011/0226479 of P. Tippet et al., but the use of ball sealers remains problematic.

The statements in this section are intended to provide background information related to the invention disclosed and claimed herein. Such information may or may not constitute prior art. It will be appreciated from the foregoing, however, that there remains a need for new and improved methods for operating valves used to stimulation well formations and to tubular assemblies used to stimulate formations. Such disadvantages and others inherent in the prior art are addressed by various aspects and embodiments of the subject invention.

SUMMARY OF THE INVENTION

The subject invention, in its various aspects and embodiments, is related generally to stimulating production from a well by injecting various fluids into a hydrocarbon bearing formation. Thus, one aspect of the invention provides methods of controlling flow into a formation through the use of a stimulation valve in a tubular assembly which is installed in a well passing through the formation. The methods comprise pumping fluid through the tubular assembly and into the formation through one or more ports in the stimulation valve. The stimulation valve defines a conduit extending axially through the valve for flow of fluids through the stimulation valve. The ports in the stimulation valve are adapted to allow flow of fluids between the conduit and the exterior of the valve and to receive a ball sealer for shutting off flow of fluids through the ports. The ports then are closed by introducing a plurality of the ball sealers into the fluid being pumped through the tubular assembly. The ball sealers are carried by the fluid into the conduit of the stimulation valve where the flow of the fluid through the ports causes the ball sealers to be received in the ports and shut off flow of the fluid through the ports.

Other aspects provide such methods where the ports have a generally circular seat adapted to receive the ball sealers.

Another aspect provides such methods where the ports in the stimulation valve are shut and the method comprises opening the ports prior to pumping the fluid through the ports.

Yet another aspect provides such methods wherein the stimulation valve comprises a sliding sleeve, and the sleeve is mounted in the stimulation valve for movement from a closed position in which the sleeve shuts off flow of fluids through the ports to an open position allowing flow of fluids through the ports. Various aspects of such methods will utilize hydraulically actuated sleeves. In other aspects of such methods the sleeve is mounted in a hydraulic cylinder and is actuated by introducing fluid into the hydraulic cylinder.

Various other aspects will utilize stimulation valves where the ports are provided is with pressure release devices allowing the ports to be opened by increasing fluid pressure in the conduit.

Yet other aspects and embodiments provide such methods where the conduit in the stimulation valve has a substantially uniform diameter. Other embodiments utilize tubular assemblies that lack a ball seat adapted to receive a ball for isolating the stimulation valve from fluid pumped into the tubular assembly. Still other aspects provide such methods where the stimulation valve lacks a ball seat adapted to receive a ball for isolating portions of the tubular assembly downhole of the stimulation valve from fluid pumped into the tubular assembly.

Further embodiments provide such methods where the tubular assembly is cemented in the well and/or where the stimulation valve is a frac valve and the method comprises pumping the fluid into the formation to fracture the formation.

Additional embodiments provide such methods which comprise discontinuing the pumping to allow the ball sealers to move away from the ports.

Another aspect provides such methods where the tubular assembly comprises a plurality of the stimulation valves and the method comprises opening the ports in a first one of the stimulation valves. Fluid is pumped through the tubular assembly and into the formation through the ports in the first valve. The ports in the first valve then are closed by introducing a plurality of the ball sealers into the fluid being pumped through the tubular assembly. The ball sealers are carried by the fluid into the conduit of the first valve where the flow of the fluid through the ports causes the ball sealers to be received in the ports and shut off flow of the fluid through the ports. Ports then are opened in a second one of the stimulation valves and fluid is pumped through the tubular assembly and into the formation through the ports in the second valve. Pumping then is discontinued to allow the ball sealers to move away from the ports in the first stimulation valve.

Especially preferred embodiments include methods of fracturing a formation in a well in first and second target zones. The methods comprise installing a tubular assembly is in the well. The tubular assembly comprises a first frac valve located in the first target zone and a second frac valve located in the second target zone. Each of the frac valves defines a conduit extending axially through the frac valve. The frac valves also comprise one or more ports allowing flow of fluids between the conduit and the exterior of the frac valve. The ports are closed when the tubular assembly is installed. Cement then is pumped through the tubular assembly and the frac valves and into the annulus between the tubular assembly and the well, after which a wiper is passed through the tubular assembly and the frac valves. Ports in the first frac valve then are opened, and fluid is pumped the ports in the first frac valve to fracture the first target zone. A plurality of ball sealers then is pumped through the tubular assembly into the conduit of the first frac valve. The ball sealers are adapted to seat on the ports of the first frac valve and shut off flow of the fluid through the ports. Ports in the second frac valve then are opened, and fluid is pumped through the ports in the second frac valve to fracture the second target zone.

Other aspects of such methods include maintaining sufficient fluid pressure in the first frac valve such that the ball sealers remain seated on the ports in the first frac valve as the ports in the second frac valve are opened and the fluid is pumped through the ports in the second frac valve and/or discontinuing the pumping to allow the ball sealers to move away from the ports in the first frac valve.

The subject invention also includes aspects and embodiments directed to tubular assemblies installed in a well bore. Such tubular assemblies comprise tubular members providing a lining for the well bore and a stimulation valve assembled into the tubular members. The stimulation valve defines a conduit extending axially through the valve. The valve also comprises one or more ports adapted to allow flow of fluids between the conduit and the exterior of the valve. The stimulation valve further comprises one or more valve members shutting off flow of fluids through the ports. The valve members are operable to open the ports to flow of fluids, but not to shut off flow of fluids after the ports have been opened. The ports are adapted to receive a ball sealer pumped into the conduit for shutting off flow of fluids through the ports. The tubular assembly lacks a ball seat adapted to receive a ball for isolating the stimulation valve from fluid pumped into the tubular assembly.

Other embodiments provide such tubular assemblies where the valve member is a sliding sleeve or a pressure release device.

Finally, still other aspect and embodiments of the invention will have various is combinations of such features as will be apparent to workers in the art.

Thus, the present invention in its various aspects and embodiments comprises a combination of features and characteristics that are directed to overcoming various shortcomings of the prior art. The various features and characteristics described above, as well as other features and characteristics, will be readily apparent to those skilled in the art upon reading the following detailed description of the preferred embodiments and by reference to the appended drawings.

Since the description and drawings that follow are directed to particular embodiments, however, they shall not be understood as limiting the scope of the invention. They are included to provide a better understanding of the invention and the manner in which it may be practiced. The subject invention encompasses other embodiments consistent with the claims set forth herein.

Figure 1A:
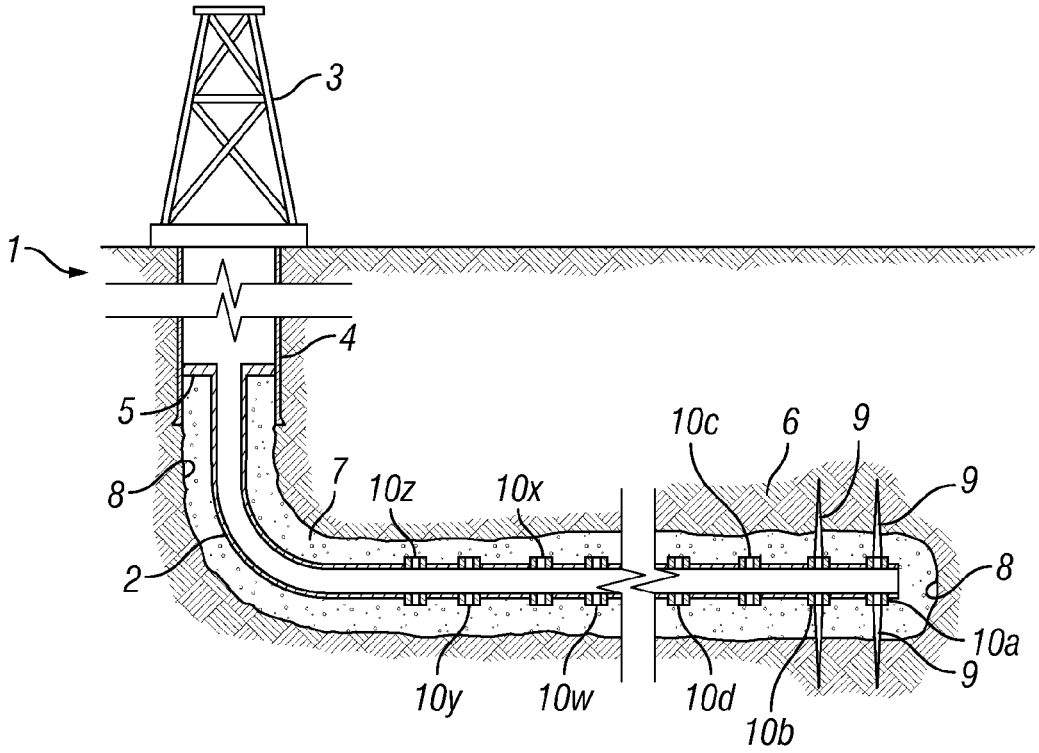
FIG. 1A is a schematic illustration of a preferred embodiment 2 of the tubular assemblies of the subject invention showing the initial stages of a frac job.

In the drawings and description that follows, like parts are identified by the same reference numerals. The drawing figures are not necessarily to scale. Certain features of the invention may be shown exaggerated in scale or in somewhat schematic form and some details of conventional design and construction may not be shown in the interest of clarity and conciseness.

DESCRIPTION OF ILLUSTRATIVE EMBODIMENTS

The subject invention relates to stimulating production from a well by injecting various fluids into a hydrocarbon bearing formation. Thus, various embodiments provide methods for controlling flow into a formation through, inter alia, the use of stimulation valves which are assembled into a tubular assembly and installed in a well drilled through the formation. There are many conventional stimulation processes, such as acidizing or water flooding, but one of the most important ways of stimulating production from wells is to fracture the formation as discussed above.

Figure 1B:
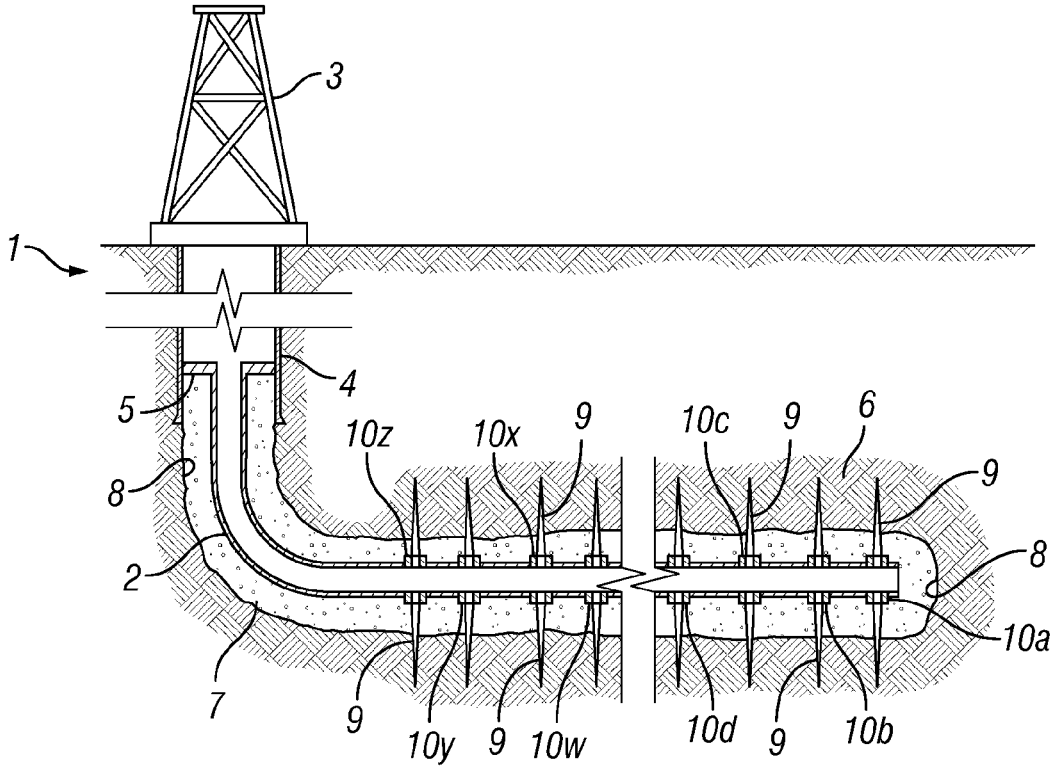
FIG. 1B is a schematic illustration of novel liner assembly 2 shown in FIG. 1A showing completion of the frac job.

FIGS. 1A and 1B, therefore, illustrate schematically a first preferred liner assembly 2 which may be used to fracture a well formation. As may be seen therein, a number of frac valves 10 may be incorporated into production liner 2 which forms part of a typical oil and gas well 1. Well 1 is serviced by a derrick 3 and various other surface equipment (not shown). The upper portion of well 1 is provided with a casing 4. Production liner 2 has been installed in the lower portion of casing 4 via a liner hanger 5. It will be noted that the lower part of well 1 extends generally horizontally through a hydrocarbon bearing formation 6 and that liner 2 has been cemented in place. That is, cement 7 has been introduced into the annular space between liner 2 and the well bore 8.

FIG. 1A shows well 1 after the initial stages of a frac job have been completed. As discussed in greater detail below, a typical frac job will generally proceed from the lowermost zone in a well to the uppermost zone. FIG. 1A, therefore, shows that fractures 9 have been established adjacent to valves 10*a* and 10*b* in the first two zones near the bottom of well 1. Zones further uphole in well 1 will be fractured in succession until, as shown in FIG. 1B, all stages of the frac job have been completed and fractures 9 have been established in all zones. It also will be noted that production liner 2 is shown only in part as such liners may extend for a substantial distance.

The portion of liner 2 not shown also will incorporate a number of valves 10, and well 1 will be provided with additional fractures 9 in the areas not shown in FIGS. 1A and 1B.

Valves used in liner 2 and in other aspects and embodiments of the invention generally comprise a valve housing which defines a central conduit and ports and a valve member for controlling flow through the ports.

Figure 2A:
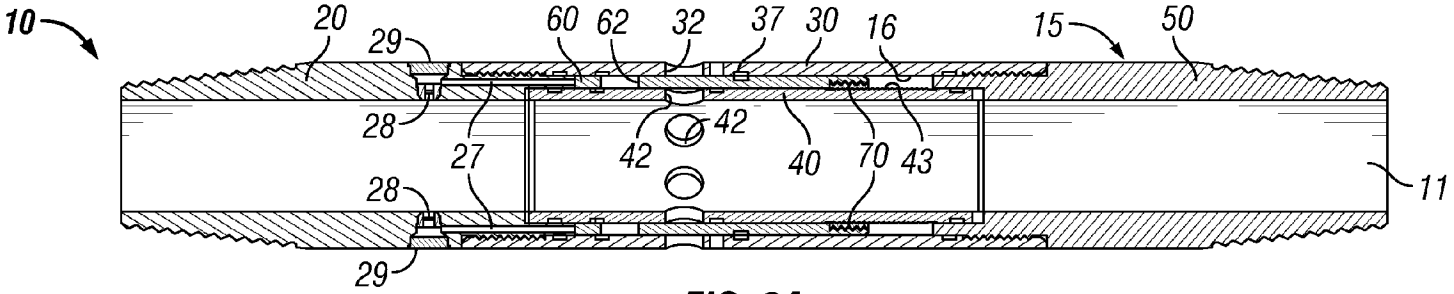
FIG. 2A is an axial cross-sectional view of a preferred valve 10 which may be used in the novel methods and incorporated into novel liner assembly 2 showing frac valve 10 in its closed or run-in position.
Figure 2B:
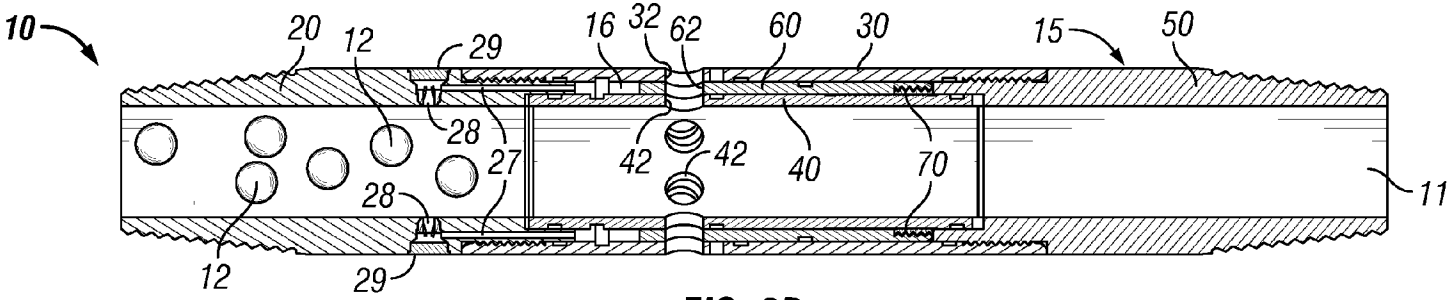
FIG. 2B is an axial cross-sectional view of frac valve 10 similar to FIG. 2A showing frac valve 10 in its open position and ball sealers being pumped into frac valve 10.
Figure 2C:
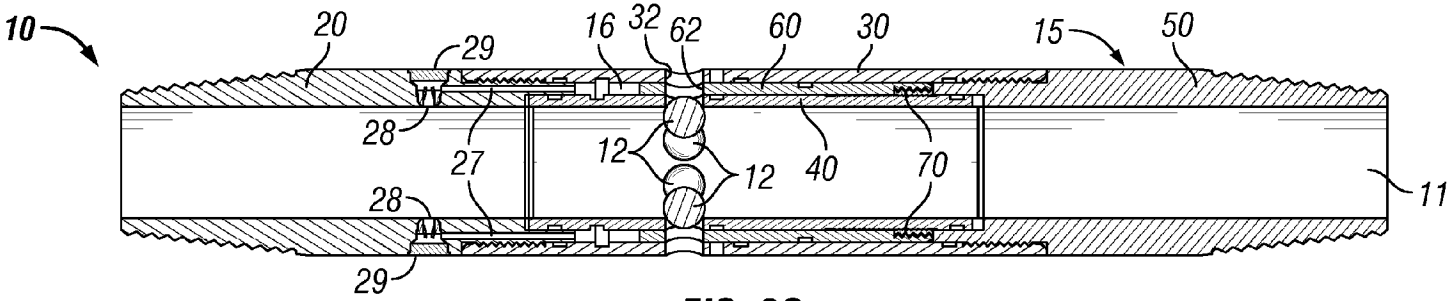
FIG. 2C is an axial cross-sectional view of frac valve 10 similar to FIGS. 2A and 2B showing frac valve 10 after it has been shut by ball sealers.

For example, as shown in greater detail in FIGS. 2A-2C, preferred valve 10 defines a central conduit 11 extending axially through valve 10. Central conduit 11 allows fluid pumped into liner 2 to pass as needed through valve 10 into downhole sections of liner 2. Frac valve 10 also defines a plurality of ports 32 and 42 which collectively allow fluid pumped into frac valve 10 to flow from conduit 11 to the exterior of valve 10 and into formation 6.

More particularly, valve 10, as may be seen from FIGS. 2A-2C, generally comprises an upper connector 20, a main housing 30, a mandrel 40, and a lower connector 50, all of which are generally cylindrical and which are assembled to form a valve housing 15.

Valve 10 also comprises a valve member, such as generally cylindrical, sliding sleeve 60, which is mounted in valve housing 15. The upper end of upper connector 20 and the lower end of lower connector 50 are adapted for assembly into liner 2, for example, by threaded connections or other connections known in the art. Main housing 30 extends between and over, and is connected to reduced external diameter portions of upper connector 20 and lower connector 50, for example, by mating threads. Mandrel 40 similarly extends between and over enlarged inner diameter portions of upper connector 20 and lower connector 50. It is held in place by shoulders formed on the enlarged inner diameter portions of the lower end of upper connector 20 and the upper end of lower connector 50. Other means of assembling upper connector 20, main housing 30, mandrel 40, and lower connector 50, however, may be employed.

It will be appreciated that the inner surfaces of upper connector 20, mandrel 40, and lower connector 50 define conduit 11. When valve 10 is assembled into liner 2, conduit 11 provides fluid communication between portions of liner 2 above and below valve 10, and fluids in liner 2 are able to pass through valve 10 in either direction as desired. Ports 32 are provided in main housing 30, and ports 42 are provided in mandrel 40. As best seen in FIG. 2B which shows valve 10 in its open position, and as described is in further detail below, ports 32 and 42 allow flow of fluids from conduit 11 during stimulation of formation 6 or into conduit 11 during production of hydrocarbons from formation 6. As is typical, the precise number and size of ports 32 and 42 may be varied to provide whatever flow capacity through ports 32 and 42 as may be desired.

As shown in FIGS. 2A-2C, main housing 30 and mandrel 40 are concentrically spaced from each other by those portions of upper connector 20 and lower connector 50 extending between their reduced outer diameter and enlarged inner diameter portions. Upper connector 20, lower connector 50, main housing 30, and mandrel 40 thereby define an annular chamber 16 extending through the mid-section of valve 10.

Sliding sleeve 60 is mounted in chamber 16 for movement from an initial closed or run-in position at the upper end of chamber 16, shown in FIG. 2A, to an open position at the lower end of chamber 16, shown in FIGS. 2B and 2C. Sliding sleeve 60 is provided with a plurality of openings 62 which, when sliding sleeve 60 is in its open position, align with ports 32 and 42 in main housing 30 and mandrel 40.

As noted above, valve 10 will be assembled into liner 2 as it is run into well 1. When valve 10 is run into well 1 sliding sleeve 60 is in its closed position shown in FIG. 2A. That is, sliding sleeve 60 is situated in the upper portion of chamber 16 in a position where it shuts off flow of fluids through ports 32 and 42. Preferably, valve 10 is provided with shear pins 37 or other devices, such as shear screws, shear wires, and the like, to releasably hold sliding sleeve 60 in its run-in position so as to avoid unintended actuation of sleeve 60 and opening of valve 10.

Since they are exposed during shipment, assembly, and run-in of valve 10, ports 32 also preferably are provided with some means of avoiding ingress of materials that might potentially interfere with operation of valve 10 once it is installed. Thus, valve 10 may be provided with a protective cover, such as a cover sleeve (not shown) extending around main housing 30 and over ports 32. Cover sleeve typically will be relatively thin and fabricated from material, such as high impact strength polymers, that it is sufficiently durable to withstand handling of valve 10, but as described below may be ruptured after valve 10 is opened.

As will be appreciated by comparing FIGS. 2A and 2B, valve 10 may be opened by moving sliding sleeve 60 to its open position. More specifically, sliding sleeve 60 is hydraulically actuated by introducing fluid into chamber 16 above sliding sleeve 60. Thus, upper connector 20 is provided with a pair of passageways 27 running longitudinally through lower portions of upper connector 20. Passageways 27 open at their lower end into chamber 16 and at their upper end into boreholes provided through the wall of upper connector 20. Pressure release devices, such as rupture disks 28, are mounted in the inner, reduced diameter portion of those boreholes, and plugs 29 are mounted in the outer, enlarged diameter portion of the boreholes.

In operation, then, valve 10 may be opened by pumping fluid into liner 2 and conduit 11. When a predetermined threshold pressure is exceeded, rupture disks 28 will rupture, allowing fluid to flow from conduit 11, through passageways 27, and into chamber 16 above sliding sleeve 60. As fluid flows into chamber 16, force exerted on sliding sleeve 60 will break sheer pins 37 and urge sliding sleeve 60 downward. Chamber 16 typically will be provided with smaller, vent ports (not shown) that will allow fluid displaced by the downward movement of sliding sleeve 60 to flow out of chamber 16. In any event, when sliding sleeve 60 bottoms out against lower connector 50, openings 62 in sliding sleeve 60 align with ports 32 and 42. Fluid flowing through ports 32, openings 62, and ports 42 will rupture the cover sleeve, allowing fluid to flow from conduit 11 to the exterior of valve 10. As fluid flows out of valve 10, it will penetrate cement 7 surrounding valve 10 and flow into formation 6.

Once valve 10 is opened, sliding sleeve 60 preferably is prevented from moving back to its closed position and shutting off ports 32 and 42. Thus, valve 10 preferably is provided a mechanism for locking sliding sleeve in its open position, such as locking ring 70. Locking ring 70 is a resilient, split ring extending around mandrel 30 in an enlarged inner diameter portion provided in the lower end of sliding sleeve 60. It is provided with annular ratchet teeth on its inner surface. Locking ring 70 also has relatively coarse, deeper threads on its outer surface which loosely engage mating threads on the inner surface of the enlarged inner diameter portion of sliding sleeve 60.

As sliding sleeve 60 travels to its open position it will carry locking ring 70 with it, and the ratchet teeth on the inner surface of locking ring 70 will encounter mating annular ratchet teeth 43 provided on the outer surface of mandrel 40 near its lower end. Locking ring 70 is a split-ring and is mounted around mandrel 30 in an expanded state. Thus, it will further expand and relax, riding over and into ratchet teeth 43 in mandrel 40 as it travels down chamber 16. The engagement of the ratchet teeth on locking ring 70 and ratchet teeth 43 on mandrel 40, along with the engagement of the coarse mating threads on locking ring 70 and sliding sleeve 60 will prevent upward movement of sliding sleeve 60, however, once it has reached its open position.

Figure 4A:
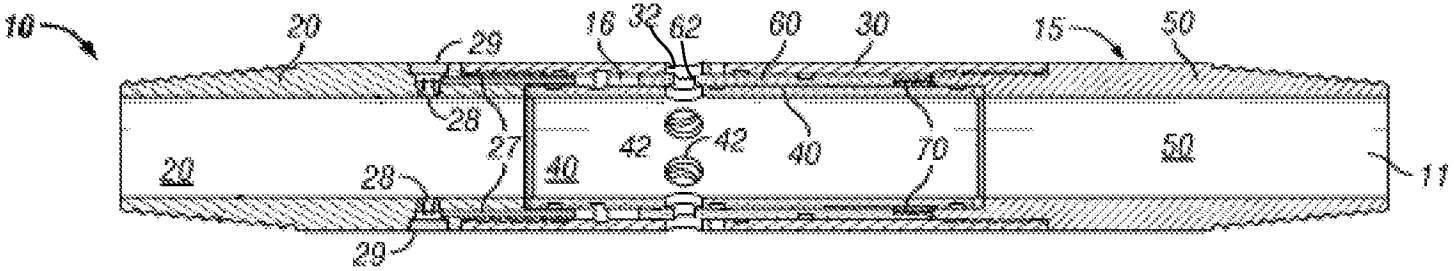
FIGS. 4A and 4B are axial cross-sectional views of frac valve 10 similar to FIGS. 2A-2C showing frac valve 10, according to another embodiment.
Figure 4B:
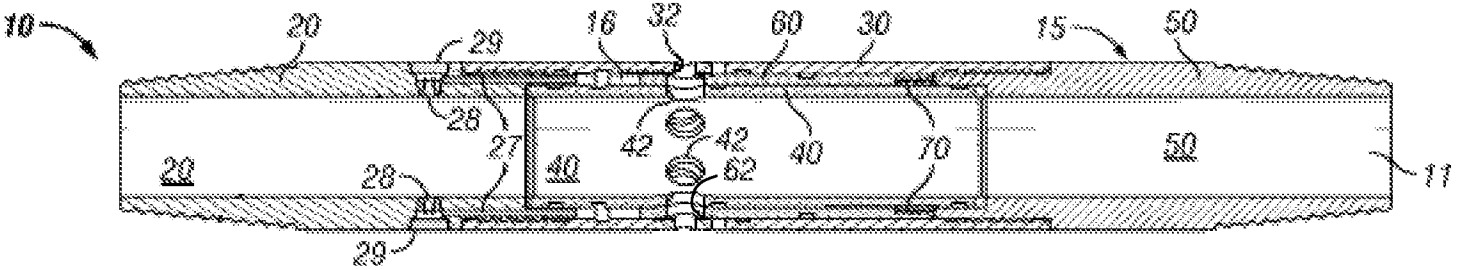

Various broader aspects and embodiments of the novel methods include closing ports in a stimulation valve by introducing a plurality of plugs into fluid being pumped through the valve so that the plugs will be carried into the ports to shut off fluid flow. Thus, it will be appreciated that flow through ports 32 and 42 in valve 10 may shut off by pumping a plurality of ball sealers 12 through liner 2 into conduit 11 of valve 10, as may be seen generally from FIG. 2B. Fluid flowing into conduit 11 will pass out of valve 10 through ports 32 and 42, carrying ball sealers toward ports 42. Ports 42 have a generally circular opening at the inner surface of mandrel 40, the edges of which provide a seat upon which the generally spherical ball sealers 12 may seat. The opening of ports 42 also may be tapered or beveled to better accommodate ball sealers 12. Thus, once ball sealer 12 has been drawn into a particular port 42, it will seat over and shut off flow through port 42, as shown in FIG. 2C. Alternatively, ports 32 and 42 and openings 62 in sliding sleeve 60 may be sized relative to each other so that ball sealers 12 pass into ports 42 and seat instead on openings 62 (as shown in FIG. 4A) or ports 32 (as shown in FIG. 4B).

Ball sealer 12, when seated on a port 42, will rest substantially outside the port 42. Depending on the size, configuration, and composition of a ball sealer and the size and configuration of the ports with which it will be used, however, the ball sealer may seat well within a port or a portion thereof. For example, if a port has a tapered or beveled opening, or a port is provide with a restricted diameter portion, a ball sealer may seat well within a port. If, as discussed in further detail below, it is somewhat deformable, it also may seat more inside the port than outside. References to a ball sealer seating or being received "on," "in," or "over" a port, therefore, will be understood in that context and not as limiting the scope of the invention.

It will be appreciated that valve 10 will incorporate various minor features typical in tool of this type which will not be discussed in any detail or have not been illustrated in the drawings for the sake of clarity and conciseness. For example, O-rings or other sealing components may be provided to provide pressure tight interfaces around sliding sleeve 60 or between other components of valve 10. Vent ports in chamber 16 also may incorporate burst discs and the like that prevent the ingress of cement or other contaminants during handling or installation of the liner. Set screws and the like also may be provided to ensure more reliable assembly of the valve. Such features in large part have been omitted from the figures for the sake of clarity, but their design and use in tools such as the valves disclosed herein is well known and well within the skill of workers in the art. In large part, therefore, discussion of such features is omitted from this description of preferred embodiments.

Advantages derived from various embodiments of the novel methods perhaps are best appreciated in the context of multi-stage fracking operations, especially when the liner is cemented in place prior to fracking. A typical multi-stage fracking operation will start by making up a production liner containing a series of valves. The valves will be used to fracture a formation in a relatively large number of stages.

Thus, as will be appreciated from FIGS. 1A and 1B, a series of valves 10*a* to 10*z* (not all of which are shown) may be incorporated into production liner 2.

It will be appreciated that valves 10 in liner 2 will be designed to actuate at differing hydraulic pressures. Preferably, the actuation pressure of valves 10 will be determined by selecting sheer pins 37 (or varying their number) to provide a predetermined sheer force for initiating movement of sliding sleeve 60. Alternately, rupture disks 28 in valves 10 will be selected and installed so that the pressures at which they rupture and allow fluid to flow into chamber 16 will become increasingly higher for each valve 10 in the series. In any event, the first valve 10 that will be opened will have the lowest actuation pressure. The second valve 10 will have the next higher actuation pressure and so forth so that the last valve 10 to be opened has the highest actuation pressure.

Valves 10 may be arranged in liner 2 and their actuation pressures determined in accordance with whatever strategy may be most suitable for fracturing formation 6. Valves 10 may be set to actuate one at a time and fracture formation 6 one zone at a time. Alternately, multiple valves 10 may be actuated at the same time to fracture formation 6 in multiple zones during a single stage. Valves 10 also may be deployed to fracture zones in any desired order, but most commonly formation 6 will be fractured from the toe up. Thus, as exemplified, valves 10 most typically will be configured and arranged such that they are actuated in succession starting with valve 10*a* and ending with valve 10*z*.

Liner 2 then may be run into a well bore and installed near the lower end of host casing 4, for example, by a liner hanger 5. Valves 10 will be in their closed, run in position. If the frac job will be performed on an open hole, the production liner also will incorporate a series of packers that will be set to seal off and isolate various zones in the well bore. If not, the liner will be cemented in place by pumping a plug of cement down the production liner, out the bottom of the liner, and into the annulus between the liner and well bore.

The cement will be allowed to harden and encase the liner, for example, as shown in FIGS. 1A and 1B, where cement 7 has encased production liner 2.

Installing a liner or other well tubular assembly with the novel frac valves may be performed by conventional methods and utilizing any number of widely available tools and supplies as are used in installing conventional liners and tubular assemblies. It will be appreciated, however, that in cementing the well it is essential to ensure that cement is pumped completely through the liner. Even small amounts of cement hung up in a liner may harden and interfere with the operation of equipment in the liner. Thus, wiper darts, plugs or the like (not shown) will be used to push cement through a liner and ensure that the internal conduit is wiped clean of any residual concrete that may impede flow of hydrocarbons or interfere with the operation of liner equipment.

Once the liner is installed, fracturing may be started by opening a valve or set of valves. Fluid is then pumped through the ports in the open valves to fracture the formation in the adjacent zone or zones. After those zones have been fractured, a plurality of ball sealers is flowed into the open valves. The ball sealers will seat on and shut off flow through the ports in the open valves. That in turn will allow another valve or set of valves to be actuated, additional zones to be fractured, and so forth until the entire formation has been fractured.

For example, after liner 2 has been installed, fluid will be pumped into liner 2 until the hydraulic pressure is sufficiently high to actuate lowermost valve 10*a* and open ports 32 and 42 therein. Pumping then will continue until fracturing of formation 6 in a first zone near the toe of well bore 8 is nearly complete. At that point, a plurality of ball sealers 12 are introduced into liner 2. The precise time at which ball sealers 12 are introduced, of course, will depend typically on the amount of fluid to be pumped into formation 6 through valve 10*a* and the fluid capacity of liner 2 uphole from valve 10*a*. In any event, once ball sealers 12 are introduced into liner 2 they will flow into valve 10*a*, seat on ports 42, and shut off flow into formation 6.

Once ball sealers 12 have shut off flow out of valve 10*a* pumping will continue until the hydraulic pressure is sufficiently high to actuate valve 10*b* uphole from valve 10*a*. Formation 6 then will be fractured in a zone adjacent valve 10*b*. Once that second zone is fractured additional ball sealers 12 are pumped down liner 2 to shut off flow into formation 6 out of valve 10*b*. That process will be repeated until formation 6 has been fractured in all zones adjacent all valves 10. When all zones have been fractured, pumping will be stopped to allow production of hydrocarbons from formation 6 to begin. The backflow of fluids from formation 6 will push ball sealers off ports 42 in valves 10, allowing hydrocarbons to flow into conduit 11 and up liner 2.

It will be appreciated that ball sealers 12 are small relative to the inner diameter of conduit 11 and liner 2. Thus, they may be easily and reliably pumped into valve 10. At the same time, once they have been displaced from ports 42 by fluid flowing from formation 6, they do not significantly interfere with subsequent well operations. Depending on their density, they will either sink to the bottom of the well or flow up to the surface. In particular, it is not necessary to drill out the well as may be required if the well was fractured using ball-drop valves or isolation plugs.

In general, therefore, ball sealers used in the novel methods will be effective to sufficiently shut off flow through the valve ports, will remain in place on the ports while other zones are being stimulated, and will release from the ports once stimulation has been completed. In large part that will depend on matching the size and geometry of the ports and ball sealers and in establishing and maintaining higher fluid pressures in the liner than are in the formation.

Thus, it will be noted that ball sealers 12, as is typical of ball sealers generally, are spherically shaped. Ports 42 are cylindrical and have an inner diameter that is relatively small compared to the inner diameter of mandrel 40. Strictly from the perspective of geometry, therefore, it is much easier to size ball sealers 12 so that they will effectively seat on the opening of ports 42. Ball sealers that are substantially spherical and ports which are substantially cylindrical, or are substantially cylindrical at least in those portions proximate to the where the ball will seat, therefore, are preferred for use in many embodiments of the subject invention.

Suitable ball sealers also typically will be somewhat resilient or deformable so as to facilitate the formation of a seal around a port. Some deformation also may be desirable in that it may allow a ball sealer to "stick" to a degree that the ball does not move off a port if there is a modest negative pressure differential between fluid in the valve and fluid in the formation. At the same time, ball sealers should not so deformable that they will be pushed through or become lodged in a port. If pushed through the port they may damage the formation. If they become stuck, they will interfere with subsequent production from the formation. The precise degree of resiliency and deformation, of course, will depend on a number of factors apparent to workers in the art, including the fluid pressures at which the ball sealers will be used.

Degradable ball sealers also may be used to advantage in the novel methods. That is, the ball sealers may be designed to fail after a period of exposure to well conditions through physical or chemical processes such as fracturing, melting, hydrolysis, solventolysis, oxidation, disintegration, or complete dissolution. Degradable ball sealers preferably will remain functional until the stimulation process is completed, but then can ensure that production will be allowed to flow back through the ports, even if the ball sealers are lodged in the ports.

The ports in valves used in the novel processes also may be designed to assist in forming a seal or in ensuring that the seal will not be lost during the stimulation process. For example, port 42 extends through the curved inner surface of mandrel 40. Thus, a slightly deformable ball sealer may be pinched by the longitudinal extremities of the opening in port 42 as it is forced radially outward into full contact with the opening. A port opening also may be beveled or tapered somewhat, for example, to provide surface area against which resilient portions of a ball sealer may be urged while the primary diameter of the port is sized to prevent passage of a ball sealer.

Similarly, bosses, lips, and the like may be provided around the opening of valve ports to capture a ball sealer on or in close proximity to the opening. Such designs may tolerate some fluctuation in differential pressure provided the "stick" may be overcome by the hydraulic pressure in the formation once stimulation has been completed. In that regard it will be noted that backflow pressures after a typical fracturing operation can be quite high. Thus, it may be possible to displace even fairly "sticky" sealer balls. On the other hand, if valve ports open on a flat surface, it may be possible to obtain a good seal even with less resilient or deformable ball sealers, and such ball sealer may be more easily displaced when production commences.

The precise requirements may differ somewhat depending on the nature of the stimulation fluids and processes, but suitable ball sealers may be selected from any of the wide variety of ball sealers known in the art and commercially available. Perhaps the most typical conventional ball sealers are hard, solid spheres made of polyamides, phenolics, syntactic foam, or aluminum which are capable of resisting extrusion through an opening. Many have a rubber coating which provides protection from solvents and aids in forming a seal.

Degradable ball sealers typically are made from polymers such as polyvinyl alcohol, polyvinyl acetate, and blends of polyethylene oxide, poly(propylene oxide), and polylactic acid. Degradable balls also may be made from anhydrous boric oxide, anhydrous sodium borate, and other anhydrous boron compounds provided with a barrier of hydrolytically degradable materials, such as those described in U.S. Pat. No. 8,434,559 to B. Todd et al. Other degradable balls include those made from carboxylic acids, fatty alcohols, fatty acid salts, or esters, such as those described in U.S. Pat. Publ. 2012/0214715 of H. Luo et al., and composite structures formed from non-degradable materials joined by degradable adhesives, such as those described in U.S. Pat. Publ. 2013/0048304 of G. Agrawal et al.

Ball sealers also may incorporate microspheres or other fillers to provide different physical or chemical properties, such as varying densities. In that regard, the novel methods encompass the use of both "sinkers," i.e., ball sealers with densities greater than the well fluid in which they will be used, and "floaters," i.e., ball sealers with densities lower than the well fluid.

Spheres are by far the most common geometry for ball sealers, and since they must match the sealer geometry fairly closely to provide an effective seal, valves most commonly will be provided with ports having a generally circular seat. Spherically shaped sealers, given that they have a point of symmetry, their center, are far more likely to land and seat on a mating port. They can flow into the port in any orientation. Thus, ball sealers that are spherical will be preferred, and in this context "spherical" shall be understood to include geometries which are generally spherical, including regular geometries approaching a spherical shape such as slightly eccentric ellipsoids, high order regular polyhedrons, or dimpled or pimpled surfaces. At the same time, however, it will be appreciated that sealing members with different geometries, regular or irregular, such as polyhedrons, parallelepipeds, prisms, cylinders, pyramids, cones, ellipsoids, may be adaptable for use with particular ports, although such sealers may require additional design features to increase the likelihood that the sealer will effectively seat on a port. In the context of this application, therefore, "ball sealers" will be understood to encompass spherical sealers and other sealing members of any particular geometry which are adapted to seat on and substantially shut off flow though a particularly configured port.

Figure 3:
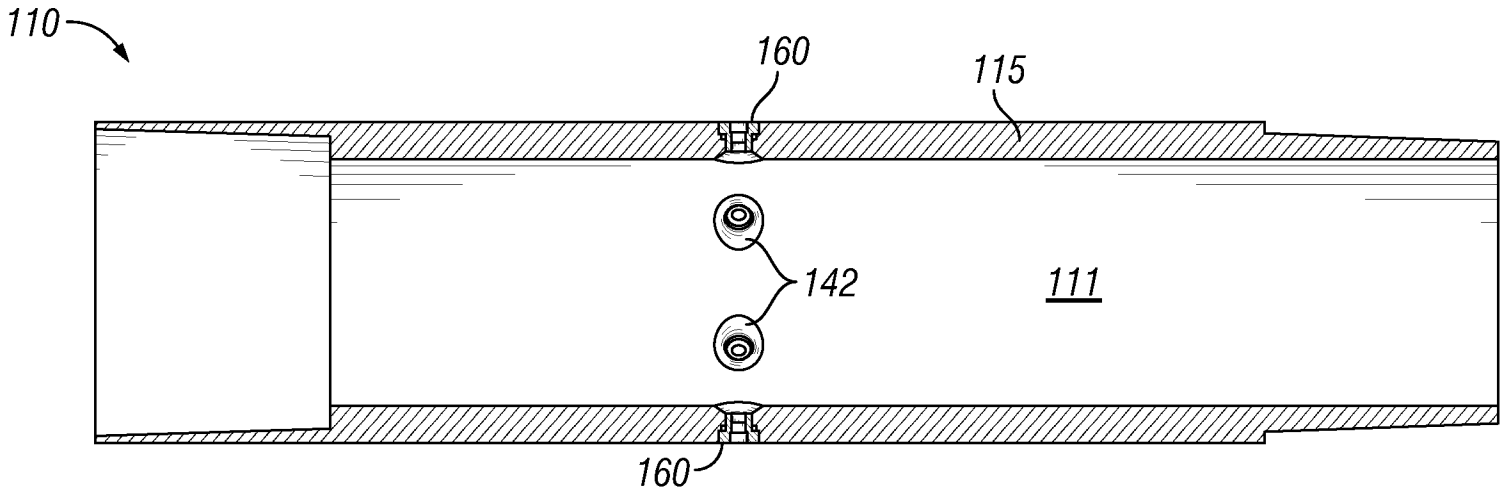
FIG. 3 is an axial cross-sectional view of a second preferred valve 110 which may be used in the novel methods and incorporated into novel liner assembly 2 showing frac valve 110 in its closed or run-in position.

Other valves, such as valve 110 shown in FIG. 3, may be used in the novel methods. Similar to valve 10, valve 110 has a valve housing 115 which defines a conduit 111 that extends axially through valve 110. The upper and lower ends of housing 115 are adapted for assembly into a tubular assembly, such as liner 2, by threaded connections or other conventional connections. Ports 142 are provided in housing 115 and allow flow of fluid between conduit 111 and the exterior of valve 110.

Valve 110 incorporates a valve member, but unlike valve 10 which is provided with sliding sleeve 60, valve 110 is provided with rupture disks 160, blowable plugs, or other conventional pressure release devices which are mounted in ports 142. Valve 110, therefore, may be opened by pumping fluid into the tubular assembly. Rupture disks 160 will rupture when a predetermined threshold pressure is exceeded, allowing fluid to flow from conduit 111, through ports 142, and into an adjacent formation.

Flow out of valve 110 may be shut off after a desired quantity of fluid has been injected into the formation in the same manner discussed above for valve 10. That is, a quantity of ball sealers may be introduced into fluid being pumped into the tubular assembly. The ball sealers will be drawn into valve 110 toward ports 142. Ports 142 have a generally circular opening into conduit 111, and therefore, ball sealers will be able to seat against the openings and shut off flow through ports 142.

In addition to illustrated valves 10 and 110, a wide variety of conventional stimulation valves may be used to advantage in the novel methods. Such valves would include those actuated by hydraulic cylinders, ball-drop mechanisms, RFID systems, or other wireless or wired communication protocols. Ball sealers suitable for plugging the ports therein may be selected, or perhaps more commonly, the ports of conventional stimulation valves may be modified to render them more compatible with the use of ball sealers. Valve 10, for example, is substantially similar to the ORIO Toe Valve sold commercially by Team Oil Tools and to the valves disclosed in U.S. Pat. No. 8,267,178 to M. Sommers et al. The ports therein have a cross section which is somewhat elongated and rounded at the ends. In valve 10 the ports have been provided with a circular cross section to render them more compatible with ball sealers.

At the same time, various embodiments of the invention utilize stimulation valves that are particularly suited to operations where a liner will be cemented in place before the well is stimulated, such as the multi-stage fracturing operation shown schematically in FIGS. 1A and 1B. As noted, if a production liner is cemented in a well bore, cement necessarily will be passed through any valves incorporated into the liner, and wiper darts may not be able to effectively remove cement. Many conventional valves have various profiles and recesses in the central conduit. Even small amounts of hardened cement in a valve may interfere with its operation.

Thus, valves used in the novel methods can and preferably do have a substantially uniform internal diameter which is relatively free of profiles. For example, there are no mechanisms, such as ball seats and the like, that extend into conduit 11 in valve 10 and conduit 111 in valve 110. Ball seats are used in many stimulation valves to actuate a sliding sleeve and open the valve, but cement may hang up on ball seats. Conduit 11 and conduit 111, however, have a substantially uniform, profile-free cylindrical shape. Wiper darts are better able to effectively remove cement from such conduits. In valve 10, it also will be noted that sliding sleeve 60 and chamber 16 are substantially isolated from conduit 11 by mandrel 30. Thus, the portions of chamber 16 into which sliding sleeve 60 must travel to open valve 10 are substantially isolated from conduit 11 and, in particular, cement passed through conduit 11.

Moreover, because ball sealers and other pumped-in plugs are used to shut off flow though ports in a valve, additional valves in the same tubular assembly may be is actuated and additional zones stimulated without shutting off flow into the valve itself. That is, most conventional stimulation valves are run into a well with their ports closed. They will incorporate mechanisms, such as hydraulic mechanisms and ball seat mechanisms, to open the ports, typically by actuating a sliding sleeve. Most such valves, however, do not have a mechanism for closing the ports once they have been opened. Thus, some means must be provided in a tubular assembly to isolate a downhole valve before an uphole valve can be actuated. Typical ball-drop valves, for example, provide such isolation. When a ball lands on the ball seat, it not only will actuate the ball-drop valve, but it will either remain on the seat or drop to another seat to isolate downhole valves from fluid pumped into the liner.

Other embodiments of the subject invention, therefore, are directed to tubular assemblies which, inter alia, incorporate stimulation valves where a valve member is operable to open ports, but not to shut off flow of fluids once the ports have been opened. The tubular assembly lacks a ball seat adapted to receive a ball for isolating the valve from fluid pumped into the tubular assembly. For example, it will be noted that sliding sleeve 60 in valve 10, once it is opened cannot be closed. Likewise, in valve 110, once rupture disks 160 have ruptured, they cannot be "unruptured." Because ports 42 and 142 in, respectively, valves 10 and 110 are shut off with ball sealers, however, liner 2 lacks any devices for shutting off the flow of fluid into valves 10. In particular, none of valves 10 have a seat upon which a ball may settle to isolate downhole valves, nor are such isolation ball seats provided elsewhere in liner 2. Such tubular assemblies are particularly suited for wells in which the tubular assembly will be cemented in the well.

It also will be appreciated that by using tubular assemblies that do not require a to valve to be isolated from fluid being pumped into the tubular before another valve or set of valves is actuated, an operator may achieve greater flexibility in designing a strategy for fracturing or otherwise stimulating a formation. For example, with a series of conventional ball-drop valves, stimulation can only proceed from the toe of the well upwards through the formation, even if a particular formation might be stimulated more efficiently if zones were fractured in a different order. By using ball sealers to shut off ports in a valve, however, it is not necessary to isolate the valve itself. Thus, zones in a formation may be stimulated in whatever order as may be most efficient for a particular formation.

In this context the description references "drop balls." Spherical balls are preferred, as they generally will be transported though well tubulars and into engagement with downhole components with greater reliability. Other conventional plugs, darts, and the like which do not have a spherical shape, however, also may be used to isolate portions of a tubular assembly. The configuration of the "ball" seats necessarily would be coordinated with the geometry of such devices. "Isolation balls," "drop balls," and "ball seats" as used herein, therefore, will be understood to include any of the various conventional plug and seat configurations that are commonly used to isolate portions of a tubular assembly, even if such plugs are not spherical or such seats are not adapted to receive spherical plugs.

Likewise, the various valves have been described as being incorporated into a liner and, more specifically, a production liner used to fracture a well in various zones along the well bore. A "liner," however, can have a fairly specific meaning within the industry, as do "casing" and "tubing." In its narrow sense, a "casing" is generally considered to be a relatively large tubular conduit, usually having an outer diameter greater than 4.5", that extends into a well from the surface and provides a lining to prevent collapse of the well bore. A "liner" is generally considered to be a relatively large tubular conduit that provides a lining which is not supported from the surface of a well. Liners are installed within an existing casing or another liner by hangers. It is, in essence, a "casing" that does not extend to the surface. "Tubing" refers to a smaller tubular conduit, usually having an outer diameter of less than 4.5". The novel valves, however, are not limited in their application to liners as that term may be understood in its narrow sense. They may be used to advantage in a variety of tubular assemblies, such as liners, casings, tubing, and other assemblies incorporating tubular conduits ("tubulars") as are commonly employed in oil and gas wells.

Similarly, the exemplified methods and tubular assemblies are particularly useful in fracturing a formation and have been exemplified in that context, but they may be used advantageously in other processes for stimulating production from a well. For example, an aqueous acid such as hydrochloric acid may be injected into a formation to clean up the formation and ultimately increase the flow of hydrocarbons into a well. In other cases, "stimulation" wells may be drilled in the vicinity of a "production" well. Water or other fluids then would be injected into the formation through the stimulation wells to drive hydrocarbons toward the production well. The novel methods and tubular assemblies may be used in such stimulation processes and others where it may be desirable to create and control fluid flow in defined zones through a well bore. Though fracturing a well bore is a common and important stimulation process, the invention is not limited thereto.

Exemplified valves 10 and 110 have been disclosed and described as being assembled from a number of separate components. Workers in the art will appreciate that many of those components may instead be assembled from separate components, or may be combined and fabricated as a single component if desired. For example, main housing 30 and upper connector 40 may be combined into a single housing component. Other modifications of this type are within the skill of workers in the art and may be made to facilitate fabrication, assembly, or servicing of the valves or to enhance its adaptability in the field.

Otherwise, the valves of the subject invention may be made of materials and by methods commonly employed in the manufacture of oil well tools in general and valves in particular. Typically, the various major components will be machined from relatively hard, high yield steel and other ferrous alloys by techniques commonly employed for tools of this type.

While this invention has been disclosed and discussed primarily in terms of specific embodiments thereof, it is not intended to be limited thereto. Other modifications and embodiments will be apparent to the worker in the art.

What is claimed is:

1. A method of controlling flow into a formation through the use of a stimulation valve in a tubular assembly installed in a well passing through said formation, said method comprising:

(a) aligning a plurality of openings in a sleeve of said stimulation valve with a plurality of ports in a mandrel of said stimulation valve to allow fluid to flow from a conduit of said stimulation valve to an exterior of said stimulation valve;

(b) pumping fluid through said tubular assembly and into said formation through said ports and said openings; and (c) preventing said fluid from flowing through said ports and said openings by introducing a plurality of ball sealers into said fluid being pumped through said tubular assembly and allowing said ball sealers to be carried by said fluid into said conduit of said stimulation valve, said flow of said fluid through said ports and said openings causing said ball sealers to seat on said openings after passing at least partially through said ports, such that said ball sealers seated in said openings shut off flow of said fluid through said ports and said openings.

2. The method of claim 1, wherein said openings have a generally circular seat adapted to receive said ball sealers.

3. The method of claim 1, wherein said sleeve is hydraulically actuated.

4. The method of claim 1, wherein said sleeve is mounted in a hydraulic cylinder and is actuated by introducing fluid into said hydraulic cylinder.

5. The method of claim 1, wherein said ports in said stimulation valve are provided with pressure release devices allowing said ports to be opened by increasing fluid pressure in said conduit.

6. The method of claim 1, wherein said conduit has a substantially uniform diameter.

7. The method of claim 1, wherein said tubular assembly lacks a ball seat that extends into the conduit and that is adapted to receive a ball for isolating said stimulation valve from fluid pumped into said tubular assembly.

8. The method of claim 1, wherein said stimulation valve lacks a ball seat that extends into the conduit and that is adapted to receive a ball for isolating portions of said tubular assembly downhole of said stimulation valve from fluid pumped into said tubular assembly.

9. The method of claim 1, wherein said stimulation valve is a frac valve and said method comprises pumping said fluid into said formation to fracture said formation.

10. The method of claim 1, wherein said method comprises discontinuing said pumping to allow said ball sealers to move away from said ports.

11. The method of claim 1, wherein said stimulation valve comprises a plurality of stimulation valves and said method comprises:

(a) aligning said openings and said ports in a first one of said stimulation valves;

(b) pumping fluid through said tubular assembly and into said formation through said ports and said openings in said first stimulation valve, (c) preventing said fluid from flowing through said ports and said openings in said first stimulation valve by introducing the ball sealers into said fluid being pumped through said tubular assembly and allowing said ball sealers to be carried by said fluid into said conduit of said first stimulation valve, said flow of said fluid through said ports and said openings causing said ball sealers to be received in said openings and shut off flow of said fluid through said ports and said openings;

(d) aligning said openings and said ports in a second one of said stimulation valves;

(e) pumping fluid through said tubular assembly and into said formation through said ports and said openings in said second stimulation valve; and (f) discontinuing said pumping to allow said ball sealers to move away from said openings in said first stimulation valve.

12. The method of claim 1, wherein said tubular assembly is cemented in said well.

13. A method of fracturing a formation in a well in first and second target zones, said method comprising:

(a) installing a tubular assembly in said well, said tubular assembly comprising a first frac valve located in said first target zone and a second frac valve located in said second target zone, each of said first and second frac valves defining a conduit extending axially therethrough, each of said first and second frac valves further comprising a mandrel having a plurality of ports and a sleeve having a plurality of openings, wherein aligning said ports and said openings allows flow of fluids between said conduit and the exterior of said first and second frac valves, said ports being misaligned when said tubular assembly is installed;

(b) pumping cement through said tubular assembly and through conduits of the first and second frac valves and into the annulus between said tubular assembly and said well;

(c) passing a wiper through said tubular assembly and said first and second frac valves;

(d) aligning said ports and said openings in said first frac valve;

(e) pumping fluid through said ports and said openings in said first frac valve to fracture said first target zone;

(f) pumping a plurality of ball sealers through said tubular assembly into said conduit of said first frac valve, said ball sealers being sized to seat on said openings of said first frac valve, thereby shutting off flow of said fluid through said ports and said openings, wherein pumping said ball sealers through the tubular assembly causes said ball sealers pass through said ports and seat on said openings;

(g) aligning said ports and said openings in said second frac valve;

(h) pumping said fluid through said ports and said openings in said second frac valve to fracture said second target zone.

14. The method of claim 13, wherein said method comprises maintaining sufficient fluid pressure in said first frac valve such that said ball sealers remain seated on said openings in said first frac valve as said ports and said openings in said second frac valve are aligned and said fluid is pumped through said ports and said openings in said second frac valve.

15. The method of claim 13, wherein said method comprises discontinuing said pumping to allow said ball sealers to move away from said openings in said first frac valve.

16. A tubular assembly installed in a well bore, said tubular assembly comprising:

(a) tubular members providing a lining for said well bore; and (b) a stimulation valve assembled into said tubular members, said stimulation valve defining a conduit extending axially through said stimulation valve, said stimulation valve further comprising a plurality of ports adapted to allow flow of fluids between said conduit and the exterior of said stimulation valve;

(c) wherein said stimulation valve comprises a valve member having a plurality of openings formed therethrough, wherein said ports and said openings are not aligned when said stimulation valve is in a first position, wherein said ports and said openings are aligned when said stimulation valve is in a second position, and wherein said stimulation valve is secured in the second position after being actuated into the second position;

(d) wherein said ports and said openings are relatively sized such that a plurality of ball sealers pumped into said conduit seat on said openings after passing at least partially through said ports, for shutting off flow of fluids through said ports and said openings;

(e) wherein said tubular assembly lacks a ball seat that extends into said conduit that is adapted to receive a ball for isolating said stimulation valve from fluid pumped into said tubular assembly.

17. The tubular assembly of claim 16, wherein said valve member is a sliding sleeve or a pressure release device.

18. A method of controlling flow into a formation through the use of a stimulation valve in a tubular assembly installed in a well passing through said formation, said method comprising:

(a) aligning a plurality of first openings in a sleeve of said stimulation valve with a plurality of ports in a mandrel of said stimulation valve to allow fluid to flow from a conduit of said stimulation valve to an exterior of said stimulation valve;

(b) pumping fluid through said tubular assembly and into said formation through said ports and said first openings; and (c) preventing said fluid from flowing through said ports and said first openings by introducing a plurality of ball sealers into said fluid being pumped through said tubular assembly and allowing said ball sealers to be carried by said fluid into said conduit of said stimulation valve, wherein said stimulation valve further comprises a housing position outside of said mandrel and said sleeve, wherein said housing has a plurality of second openings formed therethrough, said flow of said fluid through said ports and said first openings causing said ball sealers to be seated on said second openings in said housing after passing at least partially through the ports and the first openings, so as to shut off flow of said fluid through said ports, first openings, and second openings.

* * * * *